US011628347B2

(12) United States Patent
Ambrose

(10) Patent No.: US 11,628,347 B2
(45) Date of Patent: Apr. 18, 2023

(54) GOLF PUTTER GRIP WITH INTEGRATED GREEN READING AND ALIGNMENT SYSTEM AND GOLF PUTTER INCORPORATING SAME

(71) Applicant: Lateral Line, LLC., Jefferson, OH (US)

(72) Inventor: John Ambrose, Jefferson, OH (US)

(73) Assignee: LATERAL LINE, LLC, Jefferson, OH (US)

( * ) Notice: Subject to any disclaimer, the term of this patent is extended or adjusted under 35 U.S.C. 154(b) by 0 days.

(21) Appl. No.: 17/540,083

(22) Filed: Dec. 1, 2021

(65) Prior Publication Data

US 2022/0168622 A1 Jun. 2, 2022

Related U.S. Application Data

(60) Provisional application No. 63/119,961, filed on Dec. 1, 2020.

(51) Int. Cl.

| | |
|---|---|
| ***A63B 69/36*** | (2006.01) |
| ***A63B 53/00*** | (2015.01) |
| ***A63B 53/14*** | (2015.01) |

(52) U.S. Cl.

CPC ..... *A63B 69/3685* (2013.01); *A63B 53/007* (2013.01); *A63B 53/14* (2013.01)

(58) Field of Classification Search

CPC ... A63B 69/3685; A63B 53/007; A63B 53/14; A63B 2071/0694; A63B 53/0487

USPC ..... 473/226, 240

See application file for complete search history.

(56) References Cited

U.S. PATENT DOCUMENTS

| | | | | |
|---|---|---|---|---|
| 3,219,348 | A | 11/1965 | Dishner | |
| 4,067,573 | A | 1/1978 | Key, Jr. | |
| D280,119 | S | 8/1985 | McRae | |
| D355,011 | S | 1/1995 | Subnick | |
| D355,463 | S | 2/1995 | Markward et al. | |
| D377,070 | S | 12/1996 | Gurrola | |
| 5,582,554 | A * | 12/1996 | Stryczek | A63B 57/353 2/160 |
| D379,837 | S | 10/1997 | Chou et al. | |
| D391,330 | S | 2/1998 | Solheim et al. | |
| D392,357 | S | 3/1998 | Chou et al. | |
| D399,901 | S | 10/1998 | Beyer | |

(Continued)

FOREIGN PATENT DOCUMENTS

GB 2541211 A * 2/2017 ..... A63B 53/14

*Primary Examiner* — Nini F Legesse

(74) *Attorney, Agent, or Firm* — Blynn L. Shideler; Krisanne Shideler; BLK Law Group

(57) ABSTRACT

A golf putter grip includes a main body with a generally rounded diamond cross sectional shape and having and integrated green reading and alignment system, wherein the integrated green reading and alignment system includes two break measurement lines, each break measurement line on one side of the grip and configured to assist the golfer in gauging the angle of the flag, and wherein the integrated green reading and alignment system includes at least two alignment lines on a top of the grip and associated with the two break measurement lines and configured to assist in adjusting a club head face of an associated putter based upon the gauged angle of the flag. A golf putter implementing the golf putter grip with a conventional shaft and head with club face is disclosed.

12 Claims, 3 Drawing Sheets

(56) References Cited

U.S. PATENT DOCUMENTS

| | | | | |
|---|---|---|---|---|
| D408,461 | S | 4/1999 | Lamkin | |
| D431,851 | S | 10/2000 | Anderson | |
| D488,202 | S | 4/2004 | Jaffe | |
| 6,783,463 | B2 | 8/2004 | Zichmanis | |
| 6,875,125 | B1 | 4/2005 | Federowicz | |
| 6,902,492 | B1 | 6/2005 | Strand | |
| D512,758 | S | 12/2005 | Tuerschmann et al. | |
| D515,649 | S | 2/2006 | Zichmanis | |
| D524,390 | S | 7/2006 | Tuerschmann | |
| D531,243 | S | 10/2006 | Davis | |
| D545,388 | S | 6/2007 | Chen | |
| D548,808 | S | 8/2007 | Chen | |
| D590,903 | S | 4/2009 | Dingman et al. | |
| D598,512 | S | 8/2009 | Dingman et al. | |
| D652,099 | S | 1/2012 | Hohman et al. | |
| D652,100 | S | 1/2012 | Hohman et al. | |
| 8,231,479 | B1 * | 7/2012 | McIntosh | A63B 69/3685 473/282 |
| 8,241,138 | B2 * | 8/2012 | Maglaque | A63B 69/3617 473/282 |
| 8,858,356 | B2 | 10/2014 | Chu et al. | |
| D717,894 | S | 11/2014 | Dingman | |
| 8,932,146 | B2 | 1/2015 | Chu et al. | |
| 9,011,274 | B1 * | 4/2015 | Fox, Jr. | A63B 53/14 473/404 |
| 9,072,952 | B2 | 7/2015 | Chu et al. | |
| D738,973 | S | 9/2015 | Dingman | |
| D855,131 | S | 7/2019 | Chung | |
| D860,362 | S | 9/2019 | Phillips | |
| 10,682,557 | B2 | 6/2020 | Ambrose | |
| D897,466 | S | 9/2020 | Bang | |
| 2003/0181254 | A1 | 9/2003 | Zichmanis | |
| 2004/0259660 | A1 | 12/2004 | Zichmanis | |
| 2009/0253528 | A1 * | 10/2009 | Brolly | A63B 53/0487 473/340 |
| 2013/0203514 | A1 | 8/2013 | Chu et al. | |
| 2013/0225313 | A1 | 8/2013 | Garsen | |
| 2013/0260920 | A1 * | 10/2013 | Goldsmith | A63B 57/353 473/404 |
| 2014/0200097 | A1 | 7/2014 | Chu et al. | |
| 2014/0213385 | A1 | 7/2014 | Chu et al. | |
| 2014/0235371 | A1 * | 8/2014 | Dastrup | A63B 57/50 473/409 |
| 2015/0005087 | A1 | 1/2015 | Nathan | |
| 2015/0196813 | A1 | 7/2015 | Chu et al. | |
| 2016/0129324 | A1 * | 5/2016 | Saia | A63B 69/3685 473/226 |
| 2017/0087430 | A1 * | 3/2017 | Ambrose | A63B 60/14 |

* cited by examiner

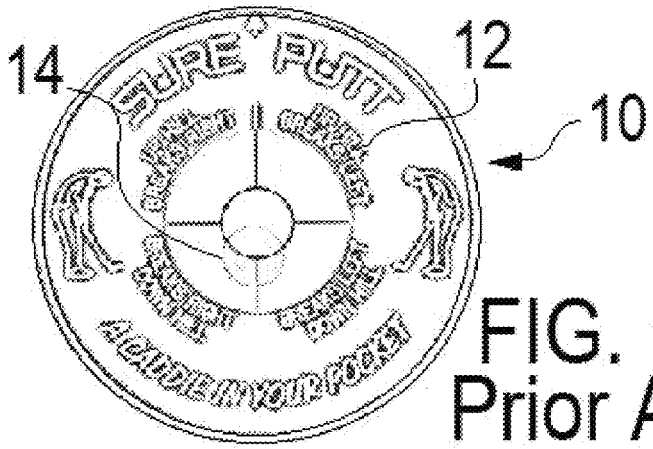
FIG. 1
Prior Art
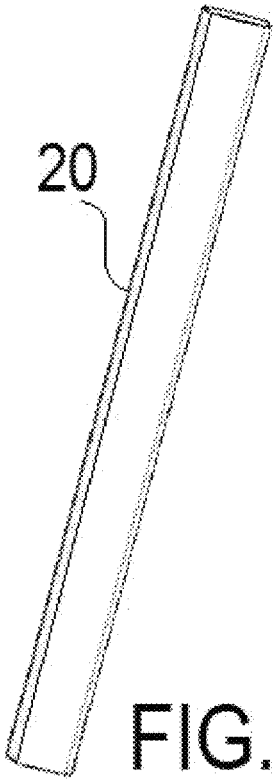
FIG. 3
FIG. 2
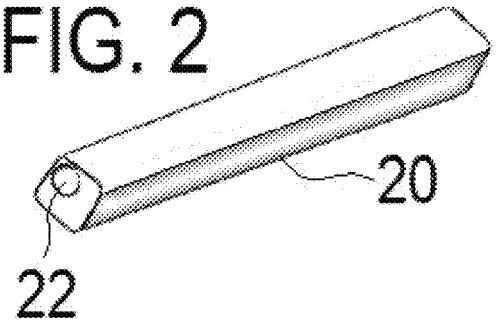
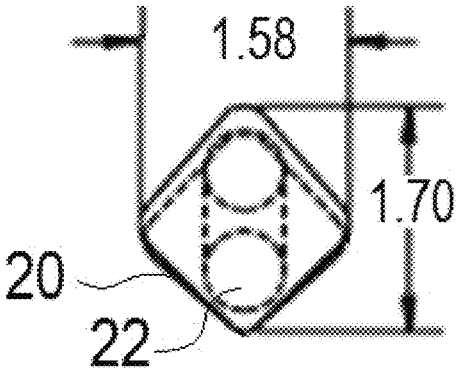
FIG. 4

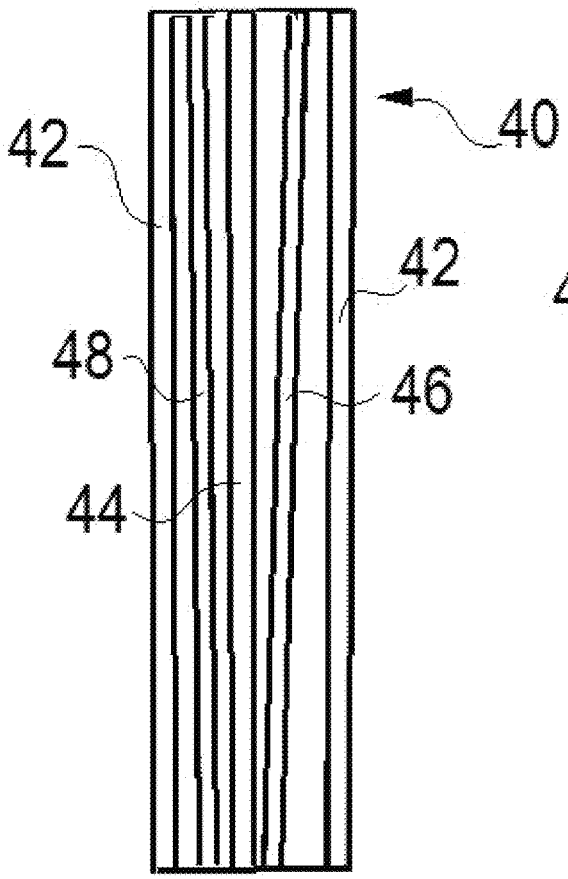
FIG. 9A
FIG. 9B
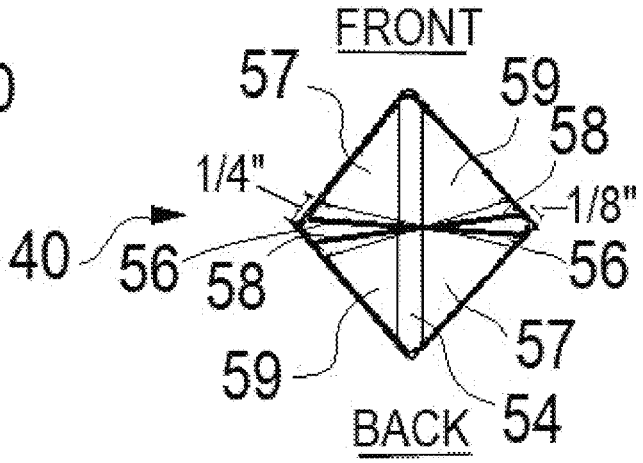
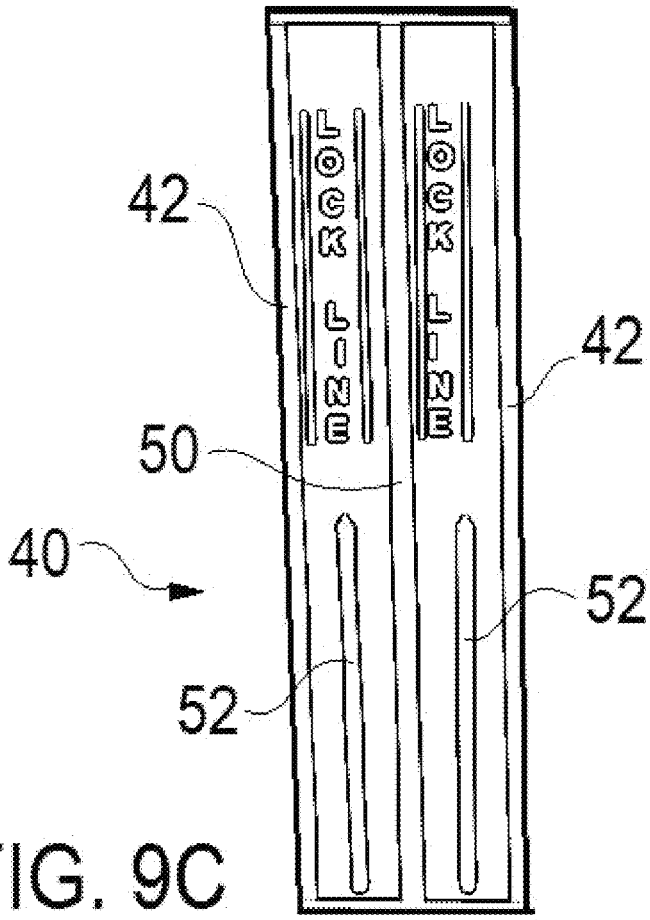
FIG. 9C

GOLF PUTTER GRIP WITH INTEGRATED GREEN READING AND ALIGNMENT SYSTEM AND GOLF PUTTER INCORPORATING SAME

RELATED APPLICATIONS

This application claims priority to U.S. provisional patent application Ser. No. 63/119,961 filed Dec. 1, 2020, titled "Golf Putter Grip with Integrated Green Reading and Alignment System and Golf Putter Incorporating Same" invented by John Ambrose.

BACKGROUND OF THE INVENTION

Field of the Invention

The present invention relates to a golf putter grip and associated putter configured to improve accurate reading of a green for putting and improved putting.

Background Information

The game of golf has a long rich history and enjoys exceptional worldwide popularity, with over 35,000 courses worldwide. For reference, in 2005, *Golf Digest* calculated that the countries with most golf courses per capita, in order, were: Scotland, New Zealand, Australia, Ireland, Canada, Wales, United States, Sweden, and England.

Putting is the act of hitting the golf ball on the putting green, most often (but not exclusively) with a putter. Putting represents one of the largest aspects of the game of golf. A putter is technically defines as a golf club with a loft not exceeding ten degrees designed primarily for use on the putting green. Considering it is often said that the average golfer takes about ⅔rds of his total shots from less than 100 feet from the hole, then it becomes evident that a golfer cannot score well without putting at least adequately. The "art" of putting however is no more easily perfected than the other parts of a golfer's game. For perspective it is often suggested that a golfer is a bad putter when they exceed 36 putts per round, and that better golfers actually use about 32 putts per round.

Golf theory teaches that the putting stroke should be executed in generally pendulum-like fashion, with the goal of allowing the golfer to putt the ball more accurately with regard to both distance and direction (or speed and line).

The grip of a golf club generally consists of material added to the shaft to enable the player to obtain a firm hold of the club. The grip is generally fixed to the shaft. The grip of the putter represents the interaction between the golfer and the putter and many attempts have been proposed to design the putter grip to improve putting mechanics. The following are some representative examples that indicate some aspect of the scope and content of the putter grip prior art.

Most notably applicant's own U.S. Pat. No. 10,682,557 discloses a putter grip designed to neutralize the dominant hand and forearm through-out the stroke, and this patent is incorporated herein by reference.

U.S. Pat. Pub. Nos. 2015-0196813, 2014-0213385 (now U.S. Pat. No. 9,072,952), 2014-0200097 (now U.S. Pat. No. 8,932,146), and 2013-0203514, (now U.S. Pat. No. 8,858, 356), disclose golf putter grips including a non-circular symmetrical cross-section with a flat front.

U.S. Pat. Pub. No. 2015-0005087 discloses a golf putter grip with a substantially flat front portion and a substantially curved rear portion and a pattern disposed on the golf putter grip that allegedly aids the golfer in perfecting the golf putter swing.

U.S. Pat. Pub. No. 2013-0225313 discloses a golf putter grip having a main grip area having a forward facing surface which is "V" shaped with the vertex of the "V" pointing away from the golfer. The rear-facing surface of the main grip area having a "C" shaped cross section which is convex from the viewpoint of the rear of the grip.

U.S. Pat. Pub. Nos. 2004-0259660 and 2003-0181254 disclose grips for a golf putter having a thumb-receiving surface and finger-receiving surfaces on opposite lateral sides thereof and normal to the thumb-receiving surface.

U.S. Pat. No. 6,902,492 discloses a putter grip including a hollow tapered body having a modified rectangular cross section.

U.S. Pat. No. 6,875,125 discloses a putter grip with two grooves each of the two grooves disposed between one of the side members and the center member of the grip.

U.S. Pat. No. 6,783,463 discloses a putter grip which has, on its front, a thumb-receiving surface, and, on respective sides, adjacent the second end, finger-receiving surfaces.

U.S. Pat. No. 3,219,348, as well as U.S. Pat. No. 4,067, 573 each discloses putter grips constructed in substantially bulbous form, which for reference is contrary to the present Rules of Golf as promulgated by the United States Golf. Developing golf innovations should attempt to comply with current golf rules or the innovation will have very limited commercial acceptance, while some would argue that such non-rule complying innovations have no place in the game.

See also the "ornamental" golf putter grip designs reflected in U.S. Design Pat. Nos. D738,973, D717,894, D652,100, D652,099, D598,512, D598,512, D590,903, D548,808, D545,388, D524,390, D515,649, D512,758, D488,202, D431,851, D408,461, D399,901, D392,357, D391,330, D379,837, D377,070, D355,463, D355,011, and D280,119.

A significant part of putting is reading the green. Reading the green is about anticipating how the golf ball will move from the putter to the hole. No green is perfectly flat, so most golfers take a close look at the slope to read the green. In addition to the slope, any hills or divots will also change the speed of the ball and, sometimes, its trajectory.

There are greed reading aids, such as a bubble-level 12 incorporating ball marker 10 with green notation 14 as shown in FIG. 1.

The above identified patents and published applications are incorporated herein by reference and give a detailed background of the prior art putter grip designs. None of these prior art solutions represents an adequate solution for all golfers and there remains a need for a golf putter grip and associated putter configured to improve accurate reading of a green for putting and improved putting.

SUMMARY OF THE INVENTION

The present invention addresses the deficiencies of the prior art and provides, according to one aspect of the invention, a golf putter grip comprising a putter incorporating this grip yields a better tempo and motion and will neutralize the dominant hand and forearm throughout the stroke, will stabilizes the hands and allow for a quieter grip to aid in reducing the yips and will reduce the wrist angle at address to relieve arm tension. The golf putter grip comprises a main body with a generally rounded diamond cross sectional shape and extending at least 7 inches (177.8 mm) in length from a top end to a bottom end, having a width less than 1.75 inches (44.45 mm) in any direction, and a shaft receiving bore within the golf putter grip extending from the bottom end substantially to the top end, wherein the shaft receiving bore is centered between lateral sides of the golf putter grip between the top end and the bottom end and wherein the shaft receiving bore is angled relative to a longitudinal center line of the main body to extend away from a front corner in the direction along the main body from the bottom end to the top end, and having and Integrated Green Reading and Alignment System.

One aspect of the invention provides a golf putter grip comprising a main body with a generally rounded diamond cross sectional shape and extending at least 7 inches (177.8 mm) in length from a top end to a bottom end, having a width less than 1.75 inches (44.45 mm) in any direction, and a shaft receiving bore within the golf putter grip extending from the bottom end substantially to the top end, and having and integrated green reading and alignment system, wherein the integrated green reading and alignment system includes at least one break measurement line on one side of the grip and configured to assist the golfer in gauging the angle of the flag. The golf putter grip according to this embodiment of the invention may further include wherein the integrated green reading and alignment system includes at least one alignment line on a top of the grip and associated with at least one break measurement line wherein the one alignment line is configures to assist in adjusting a club head face of an associated putter based upon the gauged angle of the flag. The golf putter grip according to this embodiment of the invention may provide wherein the integrated green reading and alignment system includes two break measurement lines, each break measurement line on one side of the grip and configured to assist the golfer in gauging the angle of the flag.

The golf putter grip according to one aspect of the invention may provide wherein the integrated green reading and alignment system includes at least two alignment lines on a top of the grip and associated with the two break measurement lines and configured to assist in adjusting a club head face of an associated putter based upon the gauged angle of the flag, and wherein the integrated green reading and alignment system further includes a center line between the two break measurement lines with the two break measurement lines angled in opposite directions relative to the center line. The golf putter grip according to one aspect of the invention may provide wherein the integrated green reading and alignment system includes a centerline on a top of the grip configured to be aligned with a club head face of the associated putter, and wherein the integrated green reading and alignment system includes loft indicator lines on the front of the grip configured to assist the golfer in adjusting a loft angle of the club head face of the associated putter.

One aspect of the invention provides a golf putter comprising a head with a club head face; a shaft coupled to the head; and a golf putter grip coupled to the shaft and including a main body with a generally rounded diamond cross sectional shape and extending at least 7 inches (177.8 mm) in length from a top end to a bottom end, having a width less than 1.75 inches (44.45 mm) in any direction, and a shaft receiving bore within the golf putter grip extending from the bottom end substantially to the top end, and having and integrated green reading and alignment system. The integrated green reading and alignment system may be as described above.

These and other advantages are described in the brief description of the preferred embodiments.

BRIEF DESCRIPTION OF THE FIGURES

The orientations are defined herein respective to the grip on a right handed golf club held by the golfer addressing the golf ball, wherein the front of the grip is the portion facing away from the golfer with the back or rear opposite facing the golfer, the left hand side faces toward where the ball is being directed with the right hand side facing opposite, and the top end is the proximal side of the grip and the bottom end is the distal end or club head side of the grip.

FIG. 1, discussed above, is a schematic view of a bubble level based existing green reading aid.

FIG. 2 is a schematic perspective view of a body golf club grip according to one embodiment of the present invention;

FIG. 3 is a schematic bottom end perspective view of the body of the golf club grip of FIG. 2;

FIG. 4 is a schematic top end plan view of the body of the golf club grip of FIG. 2;

FIGS. 9 A-C are schematic views, elevational rear, top and front views respectively, of the green reading assist and alignment system incorporated onto the body of the golf club of FIG. 2.

DESCRIPTION OF THE PREFERRED EMBODIMENTS

A putter is technically defined as a golf club with a loft not exceeding ten degrees designed primarily for use on the putting green. There is, however, nothing in the rules that prevents a player from using a putter off of the green and golfers frequently employ their putters from the green's fringe when there are no obstacles between the golf ball and the green. There is also nothing in the rules of golf preventing a player from putting on the green with a club other than a putter, but the game of golf is hard enough without adding unnecessary complexity. Regardless the present invention is related to a golf putter grip 20 and associated putter (comprising a shaft and putter head with club face) configured to improve putting mechanics or motions, wherein the putter grip 20 includes an integrated green reading and alignment system 40. The head with putter face and associated shaft of the putter are well known in the art and not shown or discussed in detail further herein.

Figure 5:
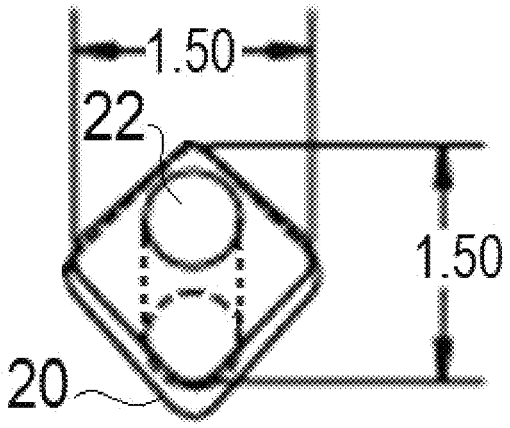
FIG. 5 is a schematic bottom end plan view of the body of the golf club grip of FIG. 2.
Figure 6:
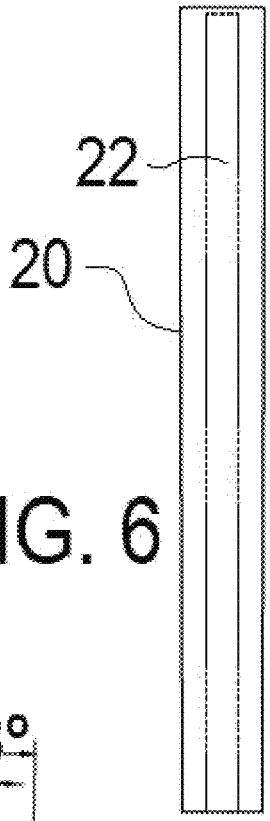
FIG. 6 is a longitudinal end section view of the body of the golf club grip of FIG. 2, taken along the axis of the shaft hole.
Figure 7:
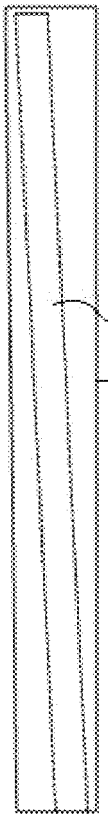
FIG. 7 is a schematic left side elevation view of the body of the golf club grip of FIG. 2, with a projection of the shaft receiving hole to illustrate the line of the shaft receiving hole in the golf club grip.
Figure 8:
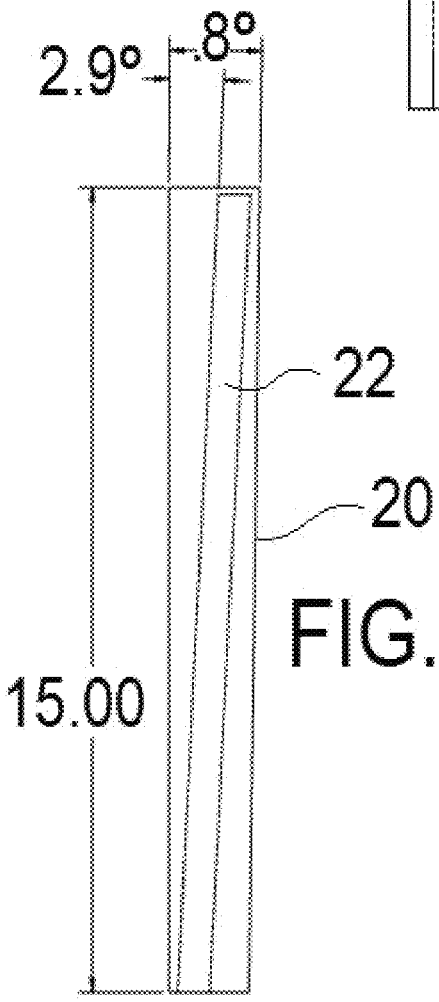
FIG. 8 is a schematic side elevation view of the body of the golf club grip of FIG. 2, with a projection of the shaft receiving hole to illustrate the line of the shaft receiving hole within the golf club grip.

The grip 20 of the invention is principally for the purpose of assisting the player in obtaining a firm hold and improving the putting mechanics and reading of the green of the player. The grip 20 is fixed to the shaft of the putter via a friction fit and or with adhesives, and is generally straight and plain in form as shown in FIGS. 2-8. The grip 20 of the invention preferably is molded in compliance with USGA and other governing body rules. The grip 20 is preferably at least seven (7) inches (177.8 mm) in length and more preferably at least 10 inches (254 mm) in length. The grip 20 of the illustrated embodiment of the present invention is 15 inches long, measured along the longitudinal length of the grip 20 as shown in FIG. 8.

The cross-sectional dimensions across the grip 20 measured in any direction preferably does not exceed 1.75 inches (44.45 mm) as conventionally measured by the USGA. The golf putter grip 20 according to the invention has a total weight generally between 100 and 250 grams. The main body may be formed of any conventional material, such as being injection molded from a hard thermosetting plastic.

The putter grip 20 according to the present invention is generally a rounded diamond shape in profile or cross-section as shown, and preferably is free of any concavity, is symmetrical on the left and right halves and is configured to remain "generally similar" through-out the length of the grip 20 as such term is known in the art (defined in the 2021 USGA rules).

The putter grip 20 according to the illustrated embodiment of the invention as general diamond shape at the top of the grip that is 1.70" front to back and 1.58" left to right at the rounded corners of the diamond shape, with the corners having 0.20" radius. The grip 20 tapers inwardly about 0.8 degrees from the top to the bottom wherein the base has dimensions of 1.70" front to back and 1.58" left to right at the rounded corners of the diamond shape, with the corners having 0.20" radius except at the front corner. The front corner has a reduced radius of 0.12" to better accommodate the shaft receiving bore 22 near the bottom.

The grip 20 of the invention includes a shaft receiving bore 22 within the golf putter grip extending from the bottom end substantially to the top end (within about 2 mm of the top end). The shaft receiving bore 22 is configured to receive the shaft of a putter therein and be secured via adhesive and/or friction fit. The shaft receiving bore 22 will be dimensioned to match the shaft, generally 0.5 inches (12.7 mm) in diameter throughout for a first common shaft diameter size and alternatively about 0.58" for a second common shaft diameter. The shaft receiving bore 22 is centered between the left and the right sides of the golf putter grip between the top end and the bottom end in a symmetrical left and right arrangement. The shaft receiving bore 22 is angled relative to a longitudinal center line of the body grip 20 to extend away from the front of the grip 20 in the direction along the body from the bottom end to the top end, essentially it runs from the front corner to the rear corner of the body from the bottom to the top of the grip 20. The golf putter grip 20 according to invention provides that the shaft receiving bore 22 is angled between 2 and 5 degrees relative to the longitudinal axis along the grip 20, generally about 3 degrees (+/−0.5 degrees) relative to the longitudinal axis along the grip 20.

The shape of the body of the grip 20 and the angle of the shaft receiving bore 22 relative to the grip 20 are designed to improve the putting mechanics for golfers.

The golf putter grip according to the invention further includes an Integrated Green Reading and Alignment System 40 shown in FIGS. 9A-C.

The Integrated Green Reading and Alignment System 40 may be formed onto a textured outer cover slipped onto the body of the grip 20, or may be in the form of decals attached to the grip 20, or painted onto the body of the grip 20 or molded into the body of the grip 20 or a combination of these techniques.

The Integrated Green Reading and Alignment System 40 may be best understood in a representative example. In reading a green for a put, the golfer stand behind the hole with the flag/hole in line with his ball (i.e. the ball, the hole and the golfer form three points along a single line, with the hole being between the golfer and the ball) and holds the putter in a two point arrangement between the thumb and forefinger at the top of the grip at the left hand and right hand side corners such that the putter acts as a plumb bob and will hang vertically. The left hand and right hand side corners of the grip 20 are marked by stripes 42. Alternatively the system can also be implemented with the golfer standing behind the ball and looking at the hole, but the break measurement lines 46 and 48 will be reversed. Some golfers may desire to read the green from the same side of the hole.

A center line 44, preferably white, along the rear corner of the diamond grip 20 (and along the longitudinal center-plane of the putter which extends through the back and front corners of the grip 20 bisecting the shaft of the putter) will serve as the plumb line and represent true vertical. A first angled break measurement line 46, preferably a blue line, is on the right hand side, and a second angled break measurement line 48, preferably a red line is on the left hand side, and the angled measurement lines 46 and 48 represent measurements for the degree of break or contour of the green. The white center line 44 or the vertical "plumb line" represents the straight line from the ball to the cup. The two angled red and blue break measurement lines 46 and 48 located and centered on either side of the white center line 44 are angled relative to the white center line and opposite to each other and are used to gauge or measure the flag angle (the angle of the flag relative to vertical) which is indicative of the degree of break or contour of the green. The two angled red and blue break measurement lines 46 and 48 are centered on respective sides of the grip 20.

The flag is considered to be positioned perpendicular to the ground and thus if the ground has a break the flag will illustrate this break relative to vertical when the flag is viewed above the top of the grip 20 with the golfer aligning the ball and the hole/flag.

There are three alignment lines on the top or cap of the grip, one 54 is used to reflect the face direction of the head (sometimes called a vertical line or center line) and a blue line 56 and a red line 58 are angled at a particular degree angle associated with blue and red break measurement lines 46 and 48. Triangular portions 57 are colored blue to match the color of the blue alignment line 56, while triangular portions 59 are colored red to match the red alignment ling 58. The triangular portions 57 and 59 act as visual guides as to the orientation of the alignment lines 56 and 58.

As an example of use of the system 40, if the flag was viewed as aligned with the blue break measurement line 46 in the reading of the green discussed above then when the golfer is addressing his put and the blue line 56 is turned to a perpendicular direction to the direction the golfer is facing (also called a horizontal position) this movement will realign the face of the putter to correct for a break or contour on the green matching that measured position. Similarly if the flag was viewed as aligned with the red break measurement line 48 in the reading of the green discussed above then when the red line 58 is turned to a perpendicular direction to the direction the golfer is facing (also called a horizontal position) this movement will realign the face of the putter to correct for a break or contour on the green matching that measured position. Following the club face adjustment using the measured flag position relative to the blue and red break measurement lines 46 and 48 and the turning of the club using the blue line 56 and a red line 58 as guides, the vertical line or center line 54 is then used by the golfer to realign his position to the properly aligned club.

Again for clarification of use of the system 40, assume that in an illustrative green reading example the flag is directly above the blue break measurement line 46 giving a measure of break, meaning that when the player addresses the ball the measured break will be toward the golfer or toward the back of the grip 20. The blue line 56 on the top of the club visible to the user will effectively define the proper face position of the club head for the measured break (technically, it shows the perpendicular line to the proper club face orientation) and the player can first adjust the putter face to conform to the proper line. Then the player can use the top white line or center line 54 to adjust his feet and grip to the properly aligned club.

If the flag measurement is only halfway to the blue break measurement line 46, for example, then the proper putting line would be only halfway to the top end blue line 56 and the putter face can be adjusted accordingly, followed by the adjustment of the golfer's position to the realigned club.

The present grip additionally includes loft indicators 52 on the front of the grip. On the front of the grip 20 are three white lines that represent the loft of the face. The center line 50 is a neutral 3 degree position positioned on the corner of the grip 20, along with a left and right lines 52. When the left or right lines 52 are placed, respectively, in a vertical position, this putter orientation will reflect more or less loft to the face which effects ball roll for a put. As shown in FIG. 9C the system 40 also has sufficient room for logos or labeling (see the lock Line logo), which is important as such branding opportunities are meaningful in golfing equipment.

The Integrated Green Reading and Alignment System 40 shown in FIGS. 9A-C gives a golfer some reference for reading a green and adjusting the put according to the measured green and measured guidance for adjustment of loft for a put.

The illustrated embodiment is only one of many embodiments of the present invention, however it is appreciated that some of the parameters of the grip may be further optimized to maximize the results. The preferred embodiments described above are illustrative of the present invention and not restrictive hereof. It will be obvious that various changes may be made to the present invention without departing from the spirit and scope of the invention. The precise scope of the present invention is defined by the appended claims and equivalents thereto.

What is claimed is:

1. A golf putter grip comprising a main body with a generally rounded diamond cross sectional shape and extending at least 7 inches (177.8 mm) in length from a top end to a bottom end, having a width less than 1.75 inches (44.45 mm) in any direction, and a shaft receiving bore within the golf putter grip extending from the bottom end substantially to the top end, and having and integrated green reading and alignment system, wherein the integrated green reading and alignment system includes two break measurement lines, each break measurement line on one side of the grip and configured to assist the golfer in gauging the angle of the flag, and wherein the integrated green reading and alignment system includes at least two alignment lines on a top of the grip and associated with the two break measurement lines and configured to assist in adjusting a club head face of an associated putter based upon the gauged angle of the flag.

2. The golf putter grip according to claim 1 wherein the integrated green reading and alignment system further includes a center line between the two break measurement lines with the two break measurement lines angled in opposite directions relative to the center line.

3. The golf putter grip according to claim 2 wherein the integrated green reading and alignment system includes a centerline on a top of the grip configured to be aligned with a club head face of the associated putter.

4. The golf putter grip according to claim 3 wherein the integrated green reading and alignment system includes loft indicator lines on the front of the grip configured to assist the golfer in adjusting a loft angle of the club head face of the associated putter.

5. A golf putter comprising:

A head with a club head face;

A shaft coupled to the head; and a

A golf putter grip coupled to the shaft and including a main body with a generally rounded diamond cross sectional shape and extending at least 7 inches (177.8 mm) in length from a top end to a bottom end, having a width less than 1.75 inches (44.45 mm) in any direction, and a shaft receiving bore within the golf putter grip extending from the bottom end substantially to the top end, and having and integrated green reading and alignment system wherein the integrated green reading and alignment system includes two break measurement lines, each break measurement line on one side of the grip and configured to assist the golfer in gauging the angle of the flag, wherein the integrated green reading and alignment system includes at least two alignment lines on a top of the grip and associated with the two break measurement lines and configured to assist in adjusting the club head face based upon the gauged angle of the flag.

6. The golf putter according to claim 5 wherein the integrated green reading and alignment system further includes a center line between the two break measurement lines with the two break measurement lines angled in opposite directions relative to the center line.

7. The golf putter according to claim 6 wherein the integrated green reading and alignment system includes a centerline on a top of the grip configured to be aligned with the club head face.

8. The golf putter grip according to claim 7 wherein the integrated green reading and alignment system includes loft indicator lines on the front of the grip configured to assist the golfer in adjusting a loft angle of the club head face.

9. A golf putter grip comprising a main body with a generally rounded diamond cross sectional shape and having a integrated green reading and alignment system, wherein the integrated green reading and alignment system includes two break measurement lines, each break measurement line on one side of the grip and configured to assist the golfer in gauging the angle of the flag, and wherein the integrated green reading and alignment system includes at least two alignment lines on a top of the grip and associated with the two break measurement lines and configured to assist in adjusting a club head face of an associated putter based upon the gauged angle of the flag.

10. The golf putter grip according to claim 9 wherein the integrated green reading and alignment system further includes a center line between the two break measurement lines with the two break measurement lines angled in opposite directions relative to the center line and of different colors from each other.

11. The golf putter grip according to claim 10 wherein the integrated green reading and alignment system includes a centerline on a top of the grip configured to be aligned with a club head face.

12. The golf putter grip according to claim 11 wherein the integrated green reading and alignment system includes loft indicator lines on the front of the grip configured to assist the golfer in adjusting a loft angle of the club head face of an associated golf putter.

* * * * *